US005628074A

United States Patent [19]

Sugihara et al.

[11] Patent Number: 5,628,074

[45] Date of Patent: May 13, 1997

[54] BATHTUB ASSEMBLY ACCOMMODATED UNDER BED AND BATHING AID SYSTEM USING IT

[75] Inventors: Kimimasa Sugihara; Kazuhiko Uchida, both of Kyoto, Japan

[73] Assignee: K.K. Seiken, Kyoto, Japan

[21] Appl. No.: 489,278

[22] Filed: Jun. 9, 1995

[30] Foreign Application Priority Data

Jun. 15, 1994 [JP] Japan ..... 6-200039
Sep. 21, 1994 [JP] Japan ..... 6-254711

[51] Int. Cl.[6] ..... A47K 3/06

[52] U.S. Cl. ..... 4/547; 4/585; 5/900

[58] Field of Search ..... 4/555, 585, 547, 4/560.1, 561.1, 564.1; 5/611, 900

[56] References Cited

U.S. PATENT DOCUMENTS

| | | | |
|---|---|---|---|
| 2,624,053 | 1/1953 | Beckwith | 4/565.1 |
| 3,093,836 | 6/1963 | Cristensen et al. | 5/600 |
| 3,469,266 | 9/1969 | Hyde | 4/560.1 |
| 3,755,830 | 9/1973 | Johns | 4/585 |
| 4,068,326 | 1/1978 | Deschler | 4/547 X |
| 4,305,165 | 12/1981 | Wall, Jr. | 4/585 X |
| 4,577,354 | 3/1986 | Stratton | 4/585 |
| 5,038,424 | 8/1991 | Carter et al. | 5/81.1 C |

FOREIGN PATENT DOCUMENTS

| | | | |
|---|---|---|---|
| 0013400 | 3/1903 | Austria | 4/585 |
| 487226 | 5/1992 | European Pat. Off. . | |
| 3766 | 2/1905 | France . | |
| 3408234 | 9/1985 | Germany . | |
| 4229176 | 9/1993 | Germany . | |
| 0021920 | 7/1909 | United Kingdom | 4/585 |
| 2008400 | 6/1979 | United Kingdom . | |

*Primary Examiner*—Robert M. Fetsuga
*Attorney, Agent, or Firm*—Oliff & Berridge

[57] ABSTRACT

A foldable bathtub assembly accommodated in a space under a bed includes: a base arranged on a floor surface to be movable between a first place under the bed and a second place on the side of the bed; a bathtub supporting frame mounted on the base to allow movement of the bathtub supporting frame in a vertical direction between an upper position and a lower position; and a bathtub made of watertight flexible cloth or plastic sheet, wherein the bathtub is fixed on its upper periphery to and suspended from the bathtub supporting frame. When the bathtub is folded and the bathtub supporting frame is in its lower position, the whole height of the bathtub assembly is sufficiently reduced to allow accommodation of the assembly in the space under the bed. When the base of the bathtub assembly is pulled out to the second place on the side of the bed and the bathtub supporting frame is vertically moved to its upper position, the bathtub assembly forms a bathtub having a sufficient depth.

5 Claims, 14 Drawing Sheets

23
17
17
18
18
15
15
20
26
13
12
19
21
22
10
12
3
11
11

BATHTUB ASSEMBLY ACCOMMODATED UNDER BED AND BATHING AID SYSTEM USING IT

The present invention relates to a foldable bathtub assembly accommodated in a space under a bed for medical purposes, as well as to a bathing aid system using the same.

BACKGROUND

Some beds used in hospitals and other medical institutions have a bathtub attached thereto for bathing a patient or a physically handicapped person bound to the bed. A bathtub attached to such a bed is normally accommodated under the bed when not in use and moved on the floor to a side of the bed when in use, in order to save a floor space. Such conventional movable bathtubs accommodated in the space under the bed, however, can not have a enough depth to allow the bathee fully relaxed in the bathtub with the entire body immersed in the hot water. Bathing not only cleans the patient, but is good for an ailing person because it enhances the blood circulation and mentally relaxes him or her.

In that respect, a large bathtub that allows the entire body to be immersed in hot water is accordingly desirable. Accommodation of such a large bathtub under the bed undesirably increases the height of the bed, which gives much inconvenience to the patient as well as for medical treatments.

SUMMARY OF THE INVENTION

The object of the present invention is thus to provide a bathtub assembly which is folded and accommodated in a space under a standard medical bed when not in use, and becomes a bathtub with a sufficient depth when pulled out to a side of the bed for use, and also to provide a bathing aid system for facilitating the movement and bathing of a person on the bed in the bathtub assembly.

In order to realize the above and the other related objects, the present invention is directed to a bathtub assembly which is foldable to be accommodated in a space under a bed. The bathtub assembly includes: a base arranged to be movable on the floor between a first place under the bed and a second place at a side of the bed; a bathtub supporting frame mounted on the base and vertically movable between an upper position and a lower position; and a bathtub made of watertight flexible sheet, wherein the bathtub is fixed at its upper periphery to the bathtub supporting frame.

In the structure of the present invention, the bathtub supporting frame, from which the watertight bathtub made of flexible sheet is suspended, is mounted on the base to allow vertical movements of the bathtub supporting frame. When the bathtub is folded and the bathtub supporting frame is in its lower position, the whole height of the bathtub assembly is sufficiently reduced to allow accommodation of the bathtub assembly in the first place space under the bed. When the base of the bathtub assembly is pulled out to the second place at a side of the bed and the bathtub supporting frame is vertically moved to the upper position, the bathtub assembly forms a bathtub having a sufficient depth.

These and other objects, features, aspects, and advantages of the present invention will become more apparent from the following detailed description of the preferred embodiments with the accompanying drawings.

DESCRIPTION OF PREFERRED EMBODIMENTS

Figure 1:
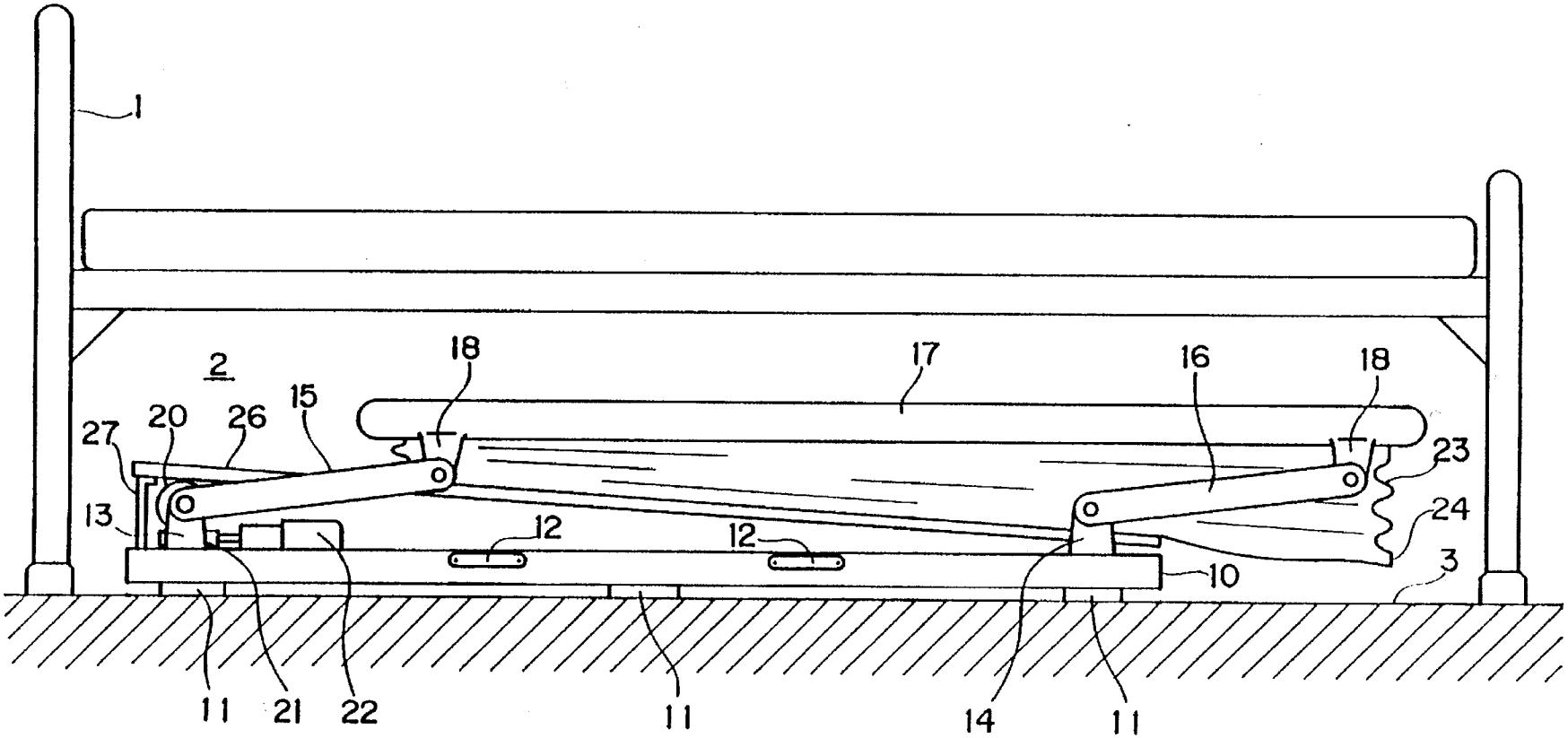
FIG. 1 is a front view illustrating a bathtub assembly of a first embodiment according to the present invention in its folded and accommodated position.
Figure 2:
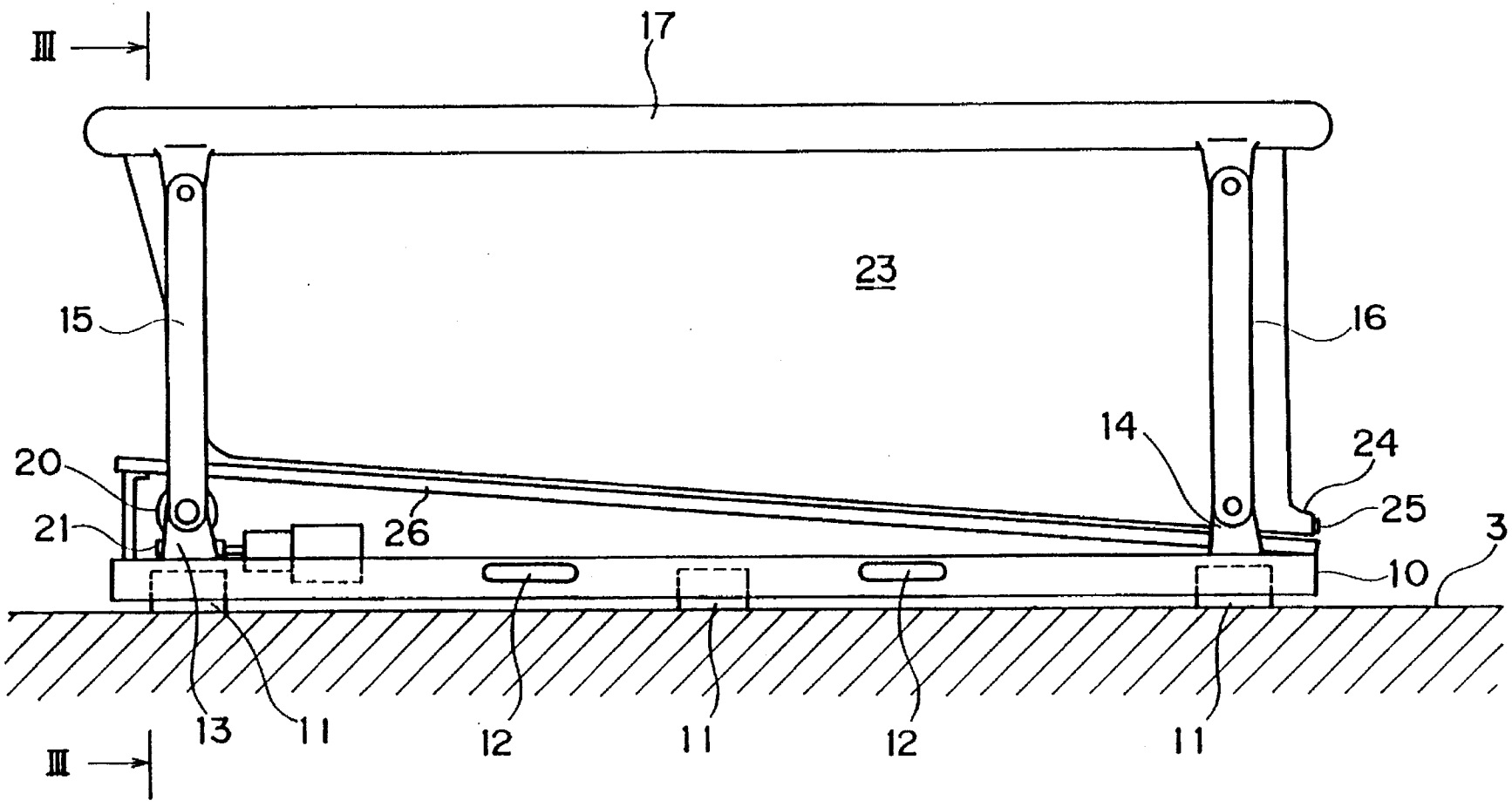
FIG. 2 is a front view illustrating the bathtub assembly of FIG. 1 set up for use.

FIG. 1 is a front view illustrating a bathtub assembly of a first embodiment according to the present invention, in its folded and accommodated position; FIG. 2 is a front view illustrating the bathtub assembly of FIG. 1 in use; and FIG. 3 is a cross sectional view illustrating the bathtub assembly, taken on the line III—III of FIG. 2.

Referring to FIG. 1, the bathtub assembly is placed on a floor (3) and accommodated in a space (2) under a bed (1) when it is not used. A base (10) is made of a rectangular plate with its periphery bent upward, and supported by a total of six casters or rollers (11) arranged in two rows on the front and rear ends of the base (10). The base (10) is movable between a first place under the bed (1) for accommodation and a second place on the side of the bed (1) for use. The base (10) is moved manually with handles (12) disposed on the front and rear ends. The casters or rollers (11) preferably have a suitable braking mechanism (not shown) to fix the base (10) at the second place while in use.

A pair of first bearings (13) are fixed on the left side (in FIG. 1) of the front and rear ends of the base (10), and a pair of second bearings (14) on the right side (in FIG. 1) of the front and rear ends of the base (10). Four link arms (15,16) of the same length are respectively fixed at their lower ends to the four bearings (13,14) to allow pivotal movement of the link arms (15,16). Upper ends of the respective link arms (15,16) are pivotally fixed to bearing plates (18), which are arranged at a configuration corresponding to the respective bearings (13,14) and projected downward from a bathtub supporting frame (17) having a rectangular shape and arranged in a horizontal position. The base (10), the two pairs of link arms (15,16), and the bathtub supporting frame (17) thus constitute a parallel (or parallelogram) link mechanism.

Figure 3:
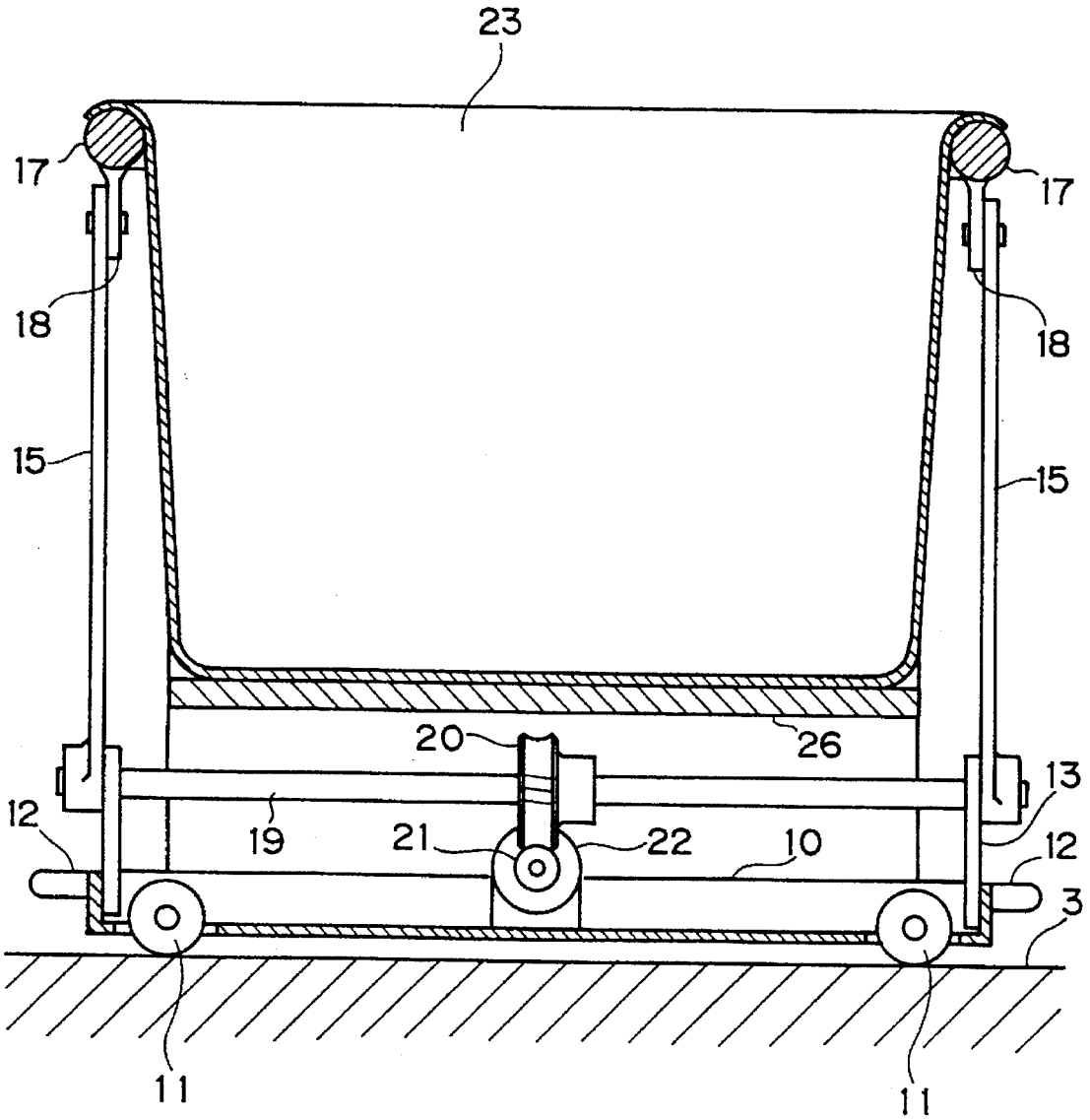
FIG. 3 is a cross sectional view illustrating the bathtub assembly taken on the line III—III of FIG. 2.

Among the two pairs of link arms (15,16), the link arms (15) on the left side of FIGS. 1 and 2 (hereinafter referred to as the head's side) are fixed on the opposing ends of a driving shaft (19) supported by the front and rear bearings (13) as shown in FIG. 3. This allows the pair of link arms (15) to pivotally move together. The link arms (16) on the right side in FIGS. 1 and 2 (hereinafter referred to as the legs' side) are independently fixed to the bearings (14) to allow pivotal movement of the link arms (16). The driving shaft (19), to which the link arms (15) on the head's side are fixed, has a worm wheel (20) fitted therein. The worm wheel (20) engages with a worm (21) driven by a motor (22) via a reduction gear mounted on the base (10). The motor (22) rotates the driving shaft (19) via the worm (21) and the worm wheel (20), and the pair of link arms (15) pivotally move together synchronously with the rotation of the driving shaft (19).

The link arms (16) on the legs' side connected with the link arms (15) on the head's side with the base (10) and the bathtub supporting frame (17) to constitute the parallel link mechanism also move pivotally, following the link arms (15). These pivotal movements allow the bathtub supporting frame (17) to be moved vertically between an upper position and a lower position while being kept horizontal.

A bathtub (23) made of watertight and flexible cloth or plastic sheet is fixed to the bathtub supporting frame (17) at its upper periphery and is suspended from the frame (17). The bathtub (23) suspended from the bathtub supporting frame (17) has dimensions to allow a patient to lie therein (generally 1.8 through 2 m in length).

A drain (24) having a stopper (25) (FIG. 2) is formed at the lower end of the legs' side of the bathtub (23).

A bottom supporting plate (26) is disposed on the base (10). The head end of the bottom supporting plate (26) is raised and supported by a strut (27) on the base (10) so that the bottom supporting plate (26) is inclined to give a higher head position and lower leg position.

When the bathtub supporting frame (17) is raised to the upper position, as shown in FIG. 3, the bathtub (23) is suspended from the bathtub supporting frame (17) with its bottom in contact with and supported by the bottom supporting plate (26).

When the bathtub supporting frame (17) is at the lower position, on the contrary, the bathtub (23) is folded between the bathtub supporting frame (17) and the bottom supporting plate (26), so that the whole bathtub assembly can be accommodated in the space (2) under the bed (1) as shown in FIG. 1.

Figure 4:
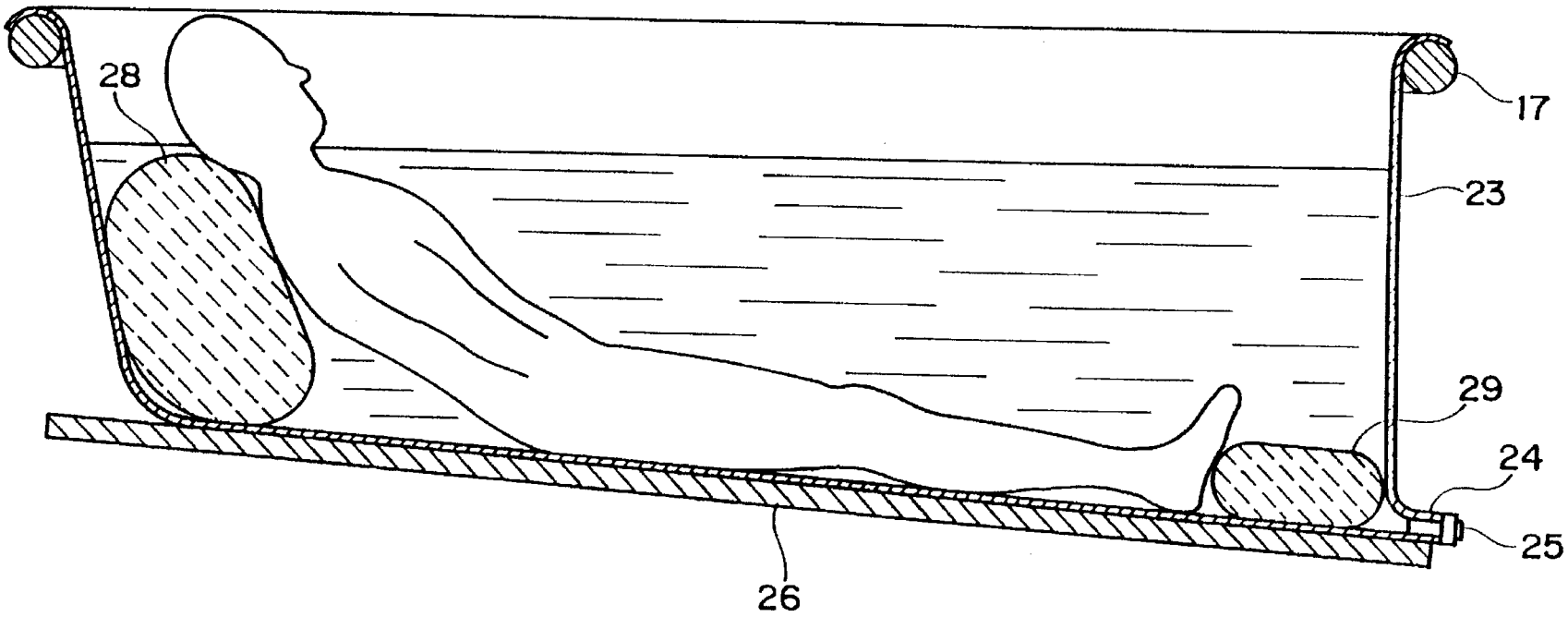
FIG. 4 is a longitudinal cross sectional view of the bathtub assembly of the first embodiment set up for use.

FIG. 4 is a cross sectional view of the bathtub assembly of the first embodiment. In FIG. 4, the bathtub supporting frame (17) is at the upper position, where the bathtub (23) is suspended from the bathtub supporting frame (17) with the bottom of the bathtub (23) supported by the bottom supporting plate (26).

After the stopper (25) is plugged in the drain (24), the bathtub (23) is filled with hot water, in which a patient is immersed. A pillow (28) and/or a foot rest (29) may be used in the bathtub assembly according to the physique of the bathee. The pillow (28) prevents the head of the patient from sinking in hot water, whereas the foot rest (29) prevents the body of the patient from sliding downward on the inclined bottom of the bathtub (23).

In actual use, before the stopper (25) is plugged into the drain (24) and the bathtub (23) is filled with hot water, the patient is laid in the bathtub (23) and the lower half of the body is cleaned with a shower or the like. Cleaning the lower half of the body first is practical especially for an aged person, since a trace of excrement may remain on that part. The cleaning hot water is let downward on the bottom of the bathtub (23) to the legs' side and is discharged from the drain (24).

Then the patient is once taken out of the bathtub (23), and the bathtub (23) is filled with hot water, in which the patient is again immersed. It is possible to charge hot water in the bathtub (23) with the patient in it. It is desirable, however, to fill hot water in the bathtub (23) in the absence of the patient and adjust the temperature before taking the patient in the bathtub (23) because the charging water may be too hot for the patient.

Figure 5:
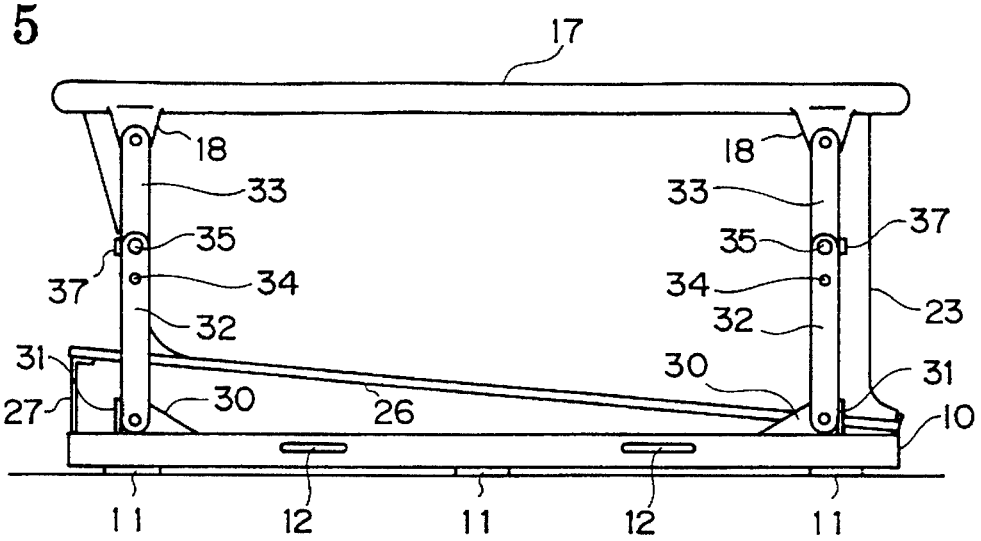
FIG. 5 is a front view illustrating a bathtub assembly of a second embodiment according to the present invention set up for use.
Figure 6:
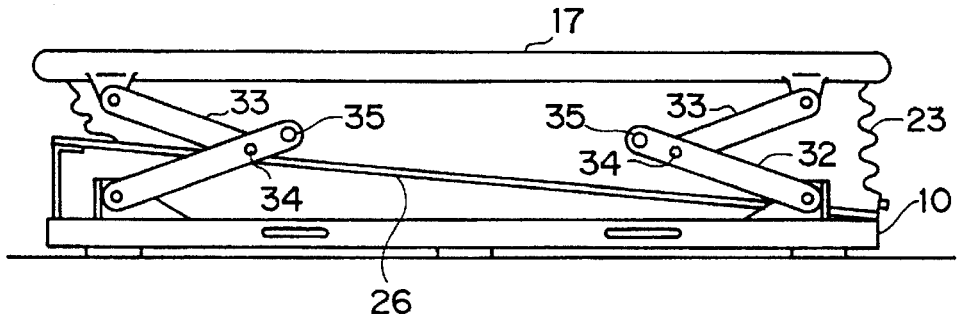
FIG. 6 is a front view illustrating the bathtub assembly of FIG. 5 in its folded and accommodated position.

FIG. 5 is a front view illustrating a bathtub assembly of a second embodiment according to the present invention, in use; and FIG. 6 is a front view illustrating the bathtub assembly of FIG. 5 in its folded and accommodated position. In these drawings, like elements to those of the first embodiment are designated by like numerals. The structure of the second embodiment is similar to that of the first embodiment, except that link arms have a different structure and that the bathtub supporting frame (17) is moved in the vertical direction not by means of the motor but by manual operations.

Figure 7:
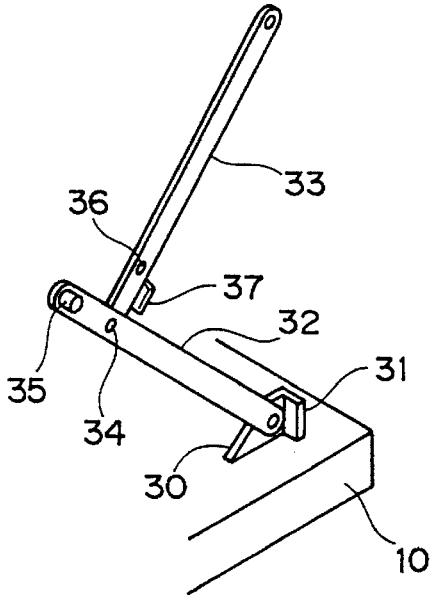
FIG. 7 is a perspective view showing a link arm structure of the second embodiment.

FIG. 7 is a perspective view showing a link arm structure of the second embodiment. Four link arms are fixed to four bearings (30) on their lower ends respectively to allow pivotal movement of the link arms. Each bearing (30) has a contact piece (31) projected substantially perpendicular to the base (10) and positioned closer to each side end of the base (10) (hereinafter referred to as outside). Each link arm includes a lower arm (32) and an upper arm (33) connected with each other via a joint (34) to allow folding movement of the link arm.

An upper end of the lower arm (32) is further extended from the joint (34) and has an engaging pin (35) for click stop as shown in FIG. 7. The upper arm (33) has an engaging hole (36) at a predetermined position corresponding to the engaging pin (35), which is fitted in the engaging hole (36) when the lower arm (32) and the upper arm (33) are set up straight in a linear configuration. A positioning element or support member (37) is attached on the outside of the upper arm (33) to which the upper end of the lower arm (32) abuts. Four link arms having such structure are symmetrically arranged on the head's side and the legs' side and bent inward as illustrated in FIG. 6.

When in use, the engaging pin (35) on the lower arm (32) of each link arm is fitted in the engaging hole (36) of the upper arm (33), so that the lower arm (32) and the upper arm (33) are fixed straight and upright as shown in FIG. 5. The link arms are further restricted by the contact piece or support member (31) arranged outside of each bearing (30) from leaning so that they securely support the bathtub supporting frame (17) at the upper position.

When not in use, the engaging pin (35) on the lower arm (32) of each link arm is taken out of the engaging hole (36) of the upper arm (33), and the joint (34) in the middle of the link arm is pressed inward by manual operations. This folds the link arms and moves the bathtub supporting frame (17) to the lower position. The bathtub (23) is folded between the bathtub supporting frame (17) and the bottom supporting plate (26), as shown in FIG. 6, so that the whole bathtub assembly can be accommodated in the space (2) under the bed (1).

The bathtub assembly of the second embodiment has manually foldable link arms and accordingly does not require any motor driving mechanism, thus being manufactured and installed at relatively low cost.

Figure 8:
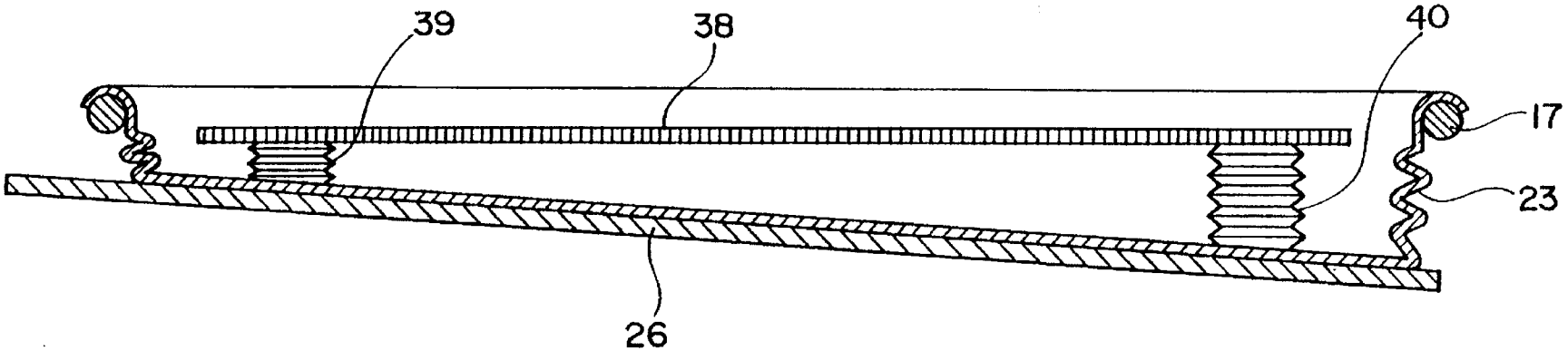
FIG. 8 is a longitudinal cross sectional view illustrating a bathtub assembly of a third embodiment according to the present invention in its folded and accommodated position.
Figure 9A:
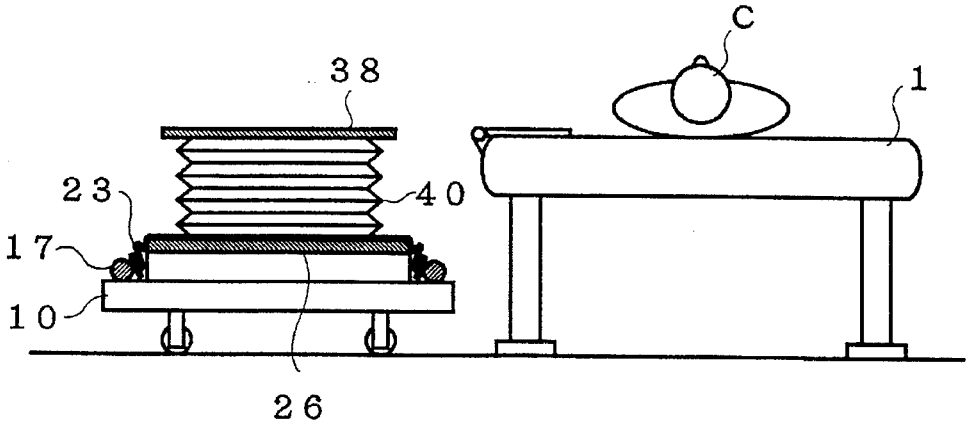
FIGS. 9A through 9C show a process of bathing a patient with the bathtub assembly of the third embodiment.
Figure 9B:
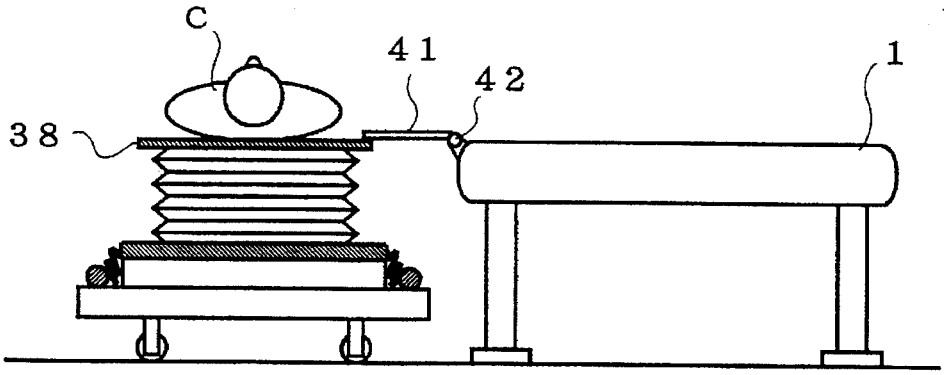
Figure 9C:
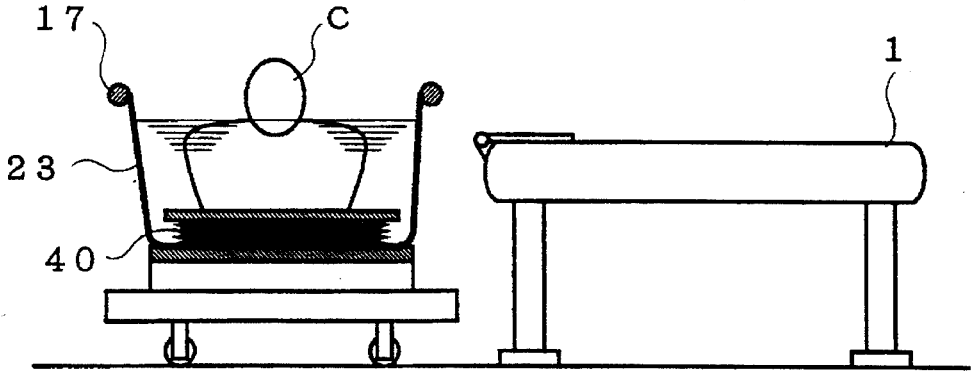

FIG. 8 is a longitudinal cross sectional view illustrating a bathtub assembly of a third embodiment according to the present invention in its folded and accommodated position; and FIGS. 9A through 9C show a process of bathing a patient with the bathtub assembly of the third embodiment. In these drawings, like elements to those of the first embodiment are designated by like numerals.

The structure of the third embodiment is similar to that of the first embodiment, except that a bottom plate (38) is placed in the bathtub (23) and is vertically movable between an upper position and a lower position. The bottom plate (38) is made of waterproof material having a sufficient mechanical strength for supporting the weight of a bathee. The bottom plate (38) is supported by a pair of bellows (39,40) on both the head's side and the legs' side.

Each bellows (39,40) expand upward by charging air therein and contracts to a lower position as shown in FIG. 8 by letting air out, and the bottom plate (38) moves accordingly in the vertical direction.

A patient is bathed with the bathtub assembly of the third embodiment as follows. As shown in FIG. 9A, the bathtub assembly is moved from a first place under the bed (1) to a second place at a side of the bed (1), and air is charged into the pair of bellows (39,40) to lift the bottom plate (38) to a height substantially equivalent to that of the bed (1).

A patient (C) is then shifted from the bed (1) to the bottom plate (38) as shown in FIG. 9B. A support plate (41) as illustrated may be used for shifting the patient (C). The support plate (41) is pivotally fixed to a pivot axis (42) mounted on the end of the bed (1) where the bathtub assembly is placed. The support plate (41) is pivotally rotated from the bed (1) to the bathtub assembly to allow the free end of the support plate (41) to be positioned on the bottom plate (38). The patient (C) is then slid on the support plate (41) and shifted to the bottom plate (38). It is possible to incline the mattress on the bed (1) by a motor or the like toward the bathtub assembly to allow the patient (C) to be more easily shifted to the bathtub assembly.

After the patient (C) is moved onto the bottom plate (38), air is let out of the bellows (39,40) to move the bottom plate (38) to the lower position near the bottom face of the bathtub (23) as shown in FIG. 9C. Then the bathtub supporting frame (17) is moved to its upper position, and the bathtub (23) is filled with an appropriate volume of hot water, in which the patient (C) is immersed. It is possible to raise the bathtub supporting frame (17) and fill the hot water in the bathtub (23) while the bottom plate (38) with the patient (C) is at the upper position. This allows an appropriate temperature adjustment of the hot water before the patient (C) is immersed.

Figure 10:
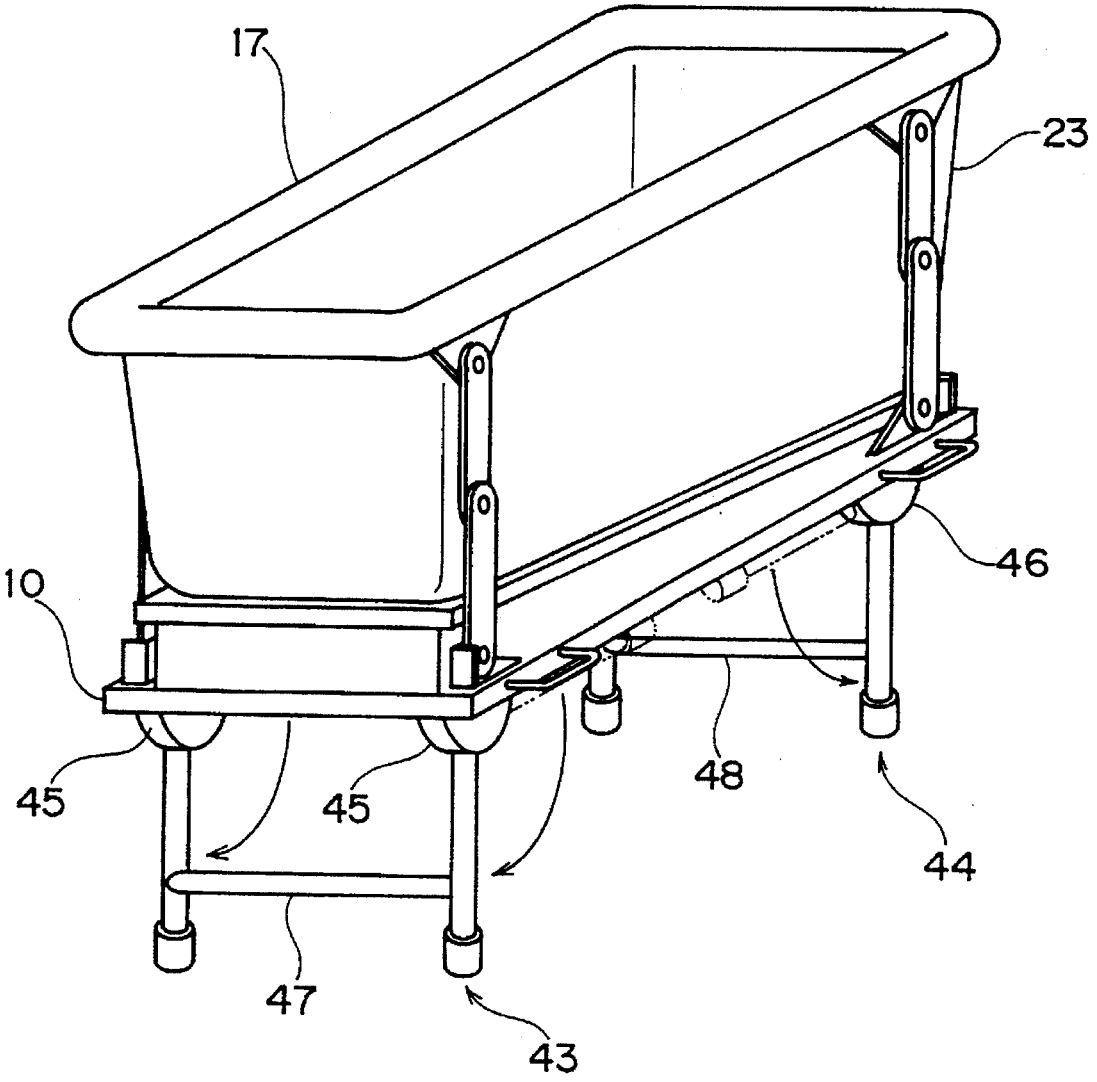
FIG. 10 is a perspective view illustrating a bathtub assembly of a fourth embodiment according to the present invention set up for use.
Figure 11A:
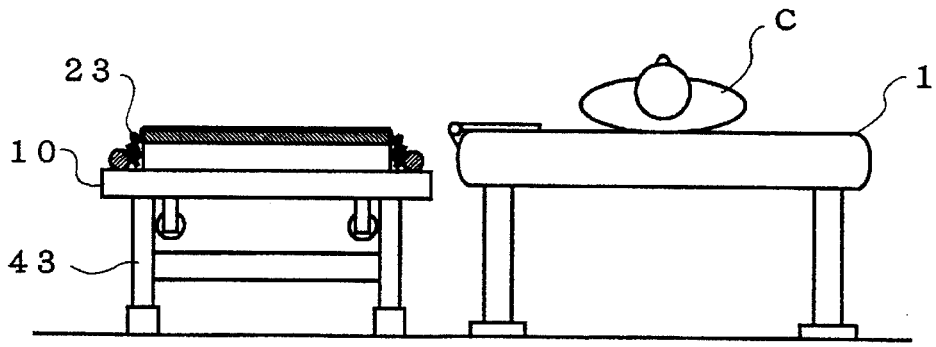
FIGS. 11A through 11C show a process of bathing a patient with the bathtub assembly of the fourth embodiment.
Figure 11B:
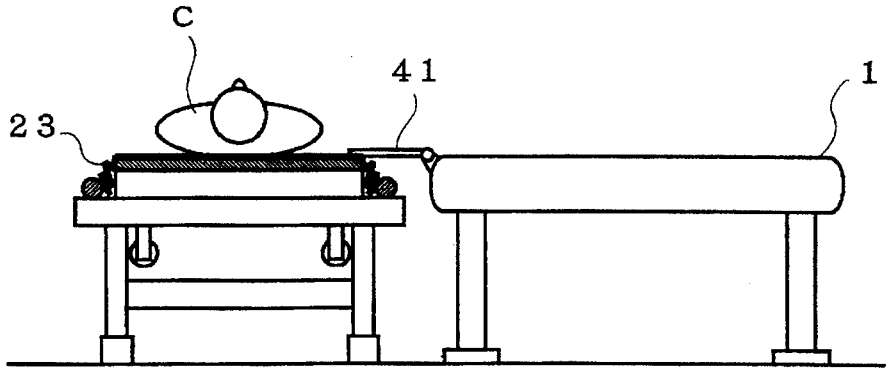
Figure 11C:
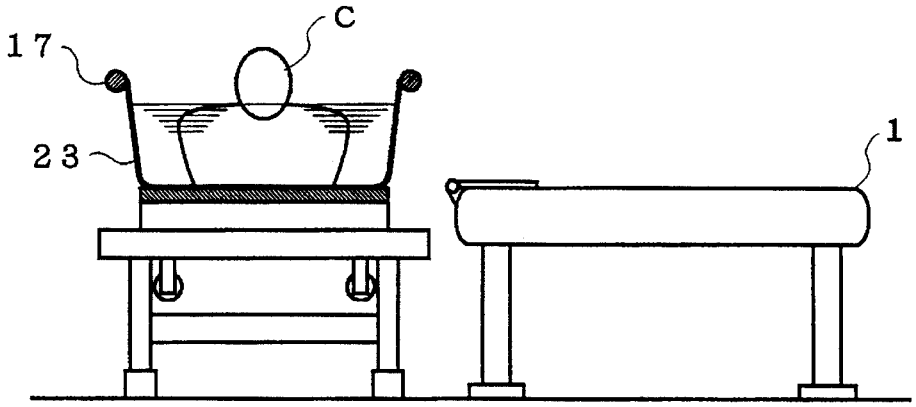

FIG. 10 is a perspective view illustrating a bathtub assembly of a fourth embodiment according to the present invention, in use; and FIGS. 11A through 11C show a process of bathing a patient with the bathtub assembly of the fourth embodiment. In these drawings, like elements to those of the third embodiment are designated by like numerals. The structure of the fourth embodiment is similar to that of the second embodiment shown in FIG. 5, except that the base (10) can be raised to a higher position from the floor surface.

Referring to FIG. 10, a pair of foldable legs (43,44) are attached to the base (10) at the head's side and at the legs' side respectively. The legs (43,44) are foldably supported by bearings (45,46), which are fixed to the bottom of the base (10) at the head's side and at the legs' side. Each leg (43,44) is composed of two struts joined by a stretcher (47,48).

The two legs (43,44) on the head's side and on the legs' side are independently pulled outside by manual operations to a standing position as shown in FIG. 10. The legs (43,44) are secured in the standing position by known means, for example, a structure used in normal tables, which includes a pin pressed by a spring and a fixation hole for receiving and engaging the pin.

A patient is bathed in the bathtub assembly of the fourth embodiment, as follows. As shown in FIG. 11A, the bathtub assembly is moved from a first place under the bed (1) to a second place at a side of the bed (1), and the two legs (43,44) at the head's side and at the legs' side are pulled out and fixed at the standing position. Thus the base (10) is raised at a preset high level on the floor, and the folded bathtub (23) is accordingly held at substantially the same height as that of the bed (1).

A patient (C) is then shifted from the bed (1) to the bathtub (23) as shown in FIG. 11B. The support plate (41) may be used for shifting the patient (C) as in the third embodiment.

As shown in FIG. 11C, after the patient (C) is moved into the bathtub (23), the bathtub supporting frame (17) is moved to its upper position, and the bathtub (23) is filled with an appropriate volume of hot water, in which the patient (C) is immersed.

Figure 12:
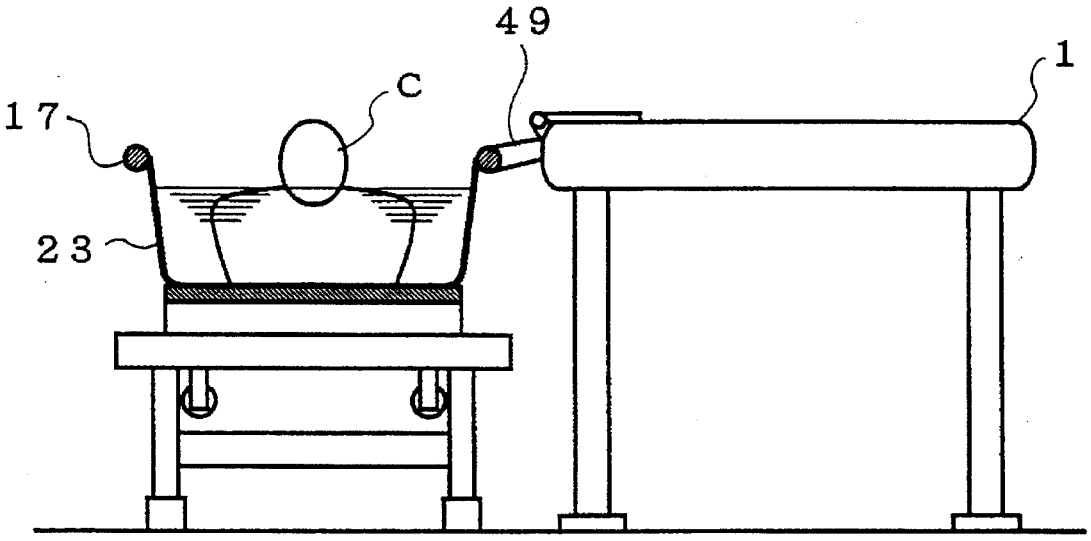
FIG. 12 shows a modified example of the bathtub assembly of the fourth embodiment.

If a lifting mechanism is incorporated in the bed (1), the mechanism can be used also to lift the bathtub supporting frame (17) by providing a coupler element (49) to the bed as illustrated in FIG. 12. When the bed (1) is raised by the lifting mechanism, the bathtub supporting frame (17) is carried upward by the coupler element (49).

The bathtub assembly of the third embodiment and the fourth embodiment helps a nurse of little strength bathe a patient without difficulty or danger. The assemblies of these embodiments do not require much strength as the conventional system, where the patient is lifted up in the arms and placed into the bathtub, but require the nurse only to slide the patient from the bed to the bathtub.

Although the bathtub assembly of the present invention is described according to the four embodiments, these embodiments are only illustrative and not restrictive in any sense. There may be many modifications, alterations, and changes without departing from the scope or spirit of essential characteristics of the present invention. Some examples of modification are given below.

A variety of known driving means can be used to vertically move the bathtub supporting frame (17) up and down, in place of the link arms of the above embodiments, including a nut and screw mechanism, an air cylinder and a hydraulic cylinder.

Any known means is applicable to keep the base (10) at a predetermined position higher than the floor surface as in the fourth embodiment, as long as it stably maintains the bathtub (23) filled with an appropriate volume of hot water, in which a patient is immersed in. For example, the base (10) may be held at the predetermined position after being elevated from the floor surface by a driving mechanism with screwed or tapped bars or that with an air cylinder or a hydraulic cylinder, like means applied for the bathtub supporting frame (17).

Figure 13:
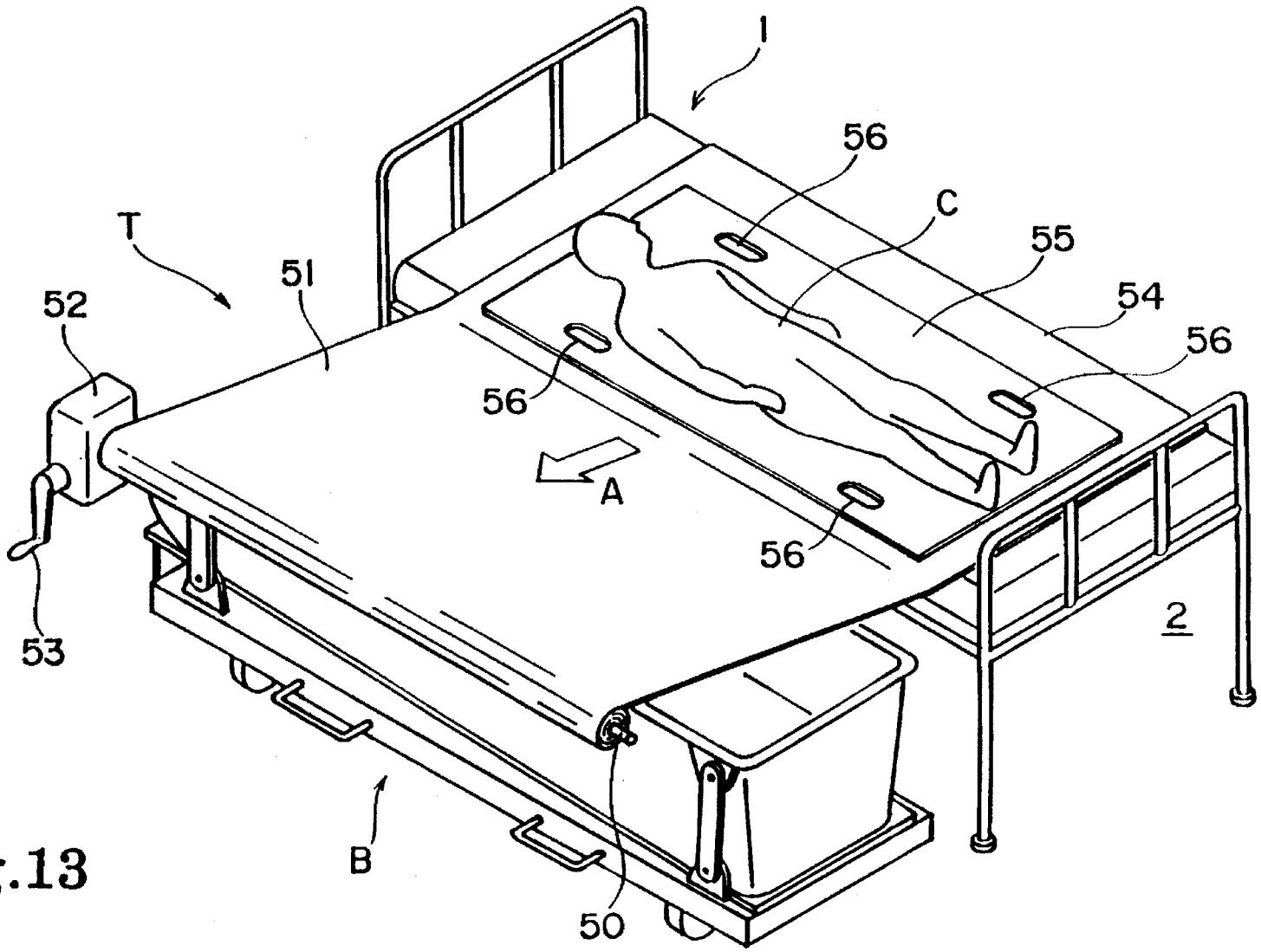
FIG. 13 is a perspective view schematically illustrating a bathing aid system embodying the present invention.

FIG. 13 is a perspective view schematically illustrating a bathing aid system embodying the present invention; and FIG. 14A through 14D show a process of bathing a patient with the bathing aid system of FIG. 13. In these drawings, like elements to those of the first through the third embodiments are designated by like numerals.

The bed (1) used for general medical treatment has the space (2) in which a bathtub assembly (B) is received and accommodated. The bathtub assembly (B) is any one of the bathtub assemblies described above.

A moving-aid mechanism (T) includes a support shaft (50) rotatably and horizontally supported across the bathtub assembly (B) substantially in parallel to the bed (1), and a flexible sheet member (51) having one end (54) fixed to the bed (1) and the other end wound on the support shaft (50). The support shaft (50) is held by a base (not shown) at a predetermined height at least equal to, or preferably a little greater than, that of the upper surface of the bed (1).

A gear box (52) with a driving gear therein is attached on one end of the support shaft (50). The gear box (52) includes an appropriate driving gear, such as a worm wheel, and rotates the support shaft (50) both clockwise and counterclockwise through operations of a crank handle (53) attached to the gear box (52).

The flexible sheet member (51) is wound on the support shaft (50). Rotations of the support shaft (50) by means of the crank handle (53) wind the sheet member (51) on and off the support shaft (50). One end (54) of the sheet member (51) is fixed at the farther end of the bed (1) without the bathtub assembly (B).

The sheet member (51) has a width a little smaller than the inner length of the bathtub assembly (B) and a length greater than the distance between the support shaft (50) and the end (54) of the sheet member (51) fixed to the bed (1). It is preferable that the length of the sheet member (51) reaches the bottom of the bathtub assembly (B) set at the position in use.

The sheet member (51) is made of a material having sufficient tensile strength and water resistance as well as flexibility to be wound on the support shaft (50). The material of the sheet member (51) preferably has smooth surface with a small coefficient of friction. A typical example of such material for the sheet member (51) is Tetron #130 Tafta manufactured by Toray Industries Inc.

A rectangular second sheet member (55) is mounted on the sheet member (51). The second sheet member (55) is made of the same material as that of the sheet member (51) and has a small coefficient of friction against the sheet member (51) to allow a slide of the second sheet member (55) on the sheet member (51). The second sheet member (55) has a length substantially equivalent to the width of the sheet member (51) and a width substantially equivalent to the width of the bed (1).

A plurality of (at least two) grip holes (56) are formed on both sides of the length of the second sheet member (55) for the convenience of a nurse who transfers a patient (C) for bathing.

Figure 14A:
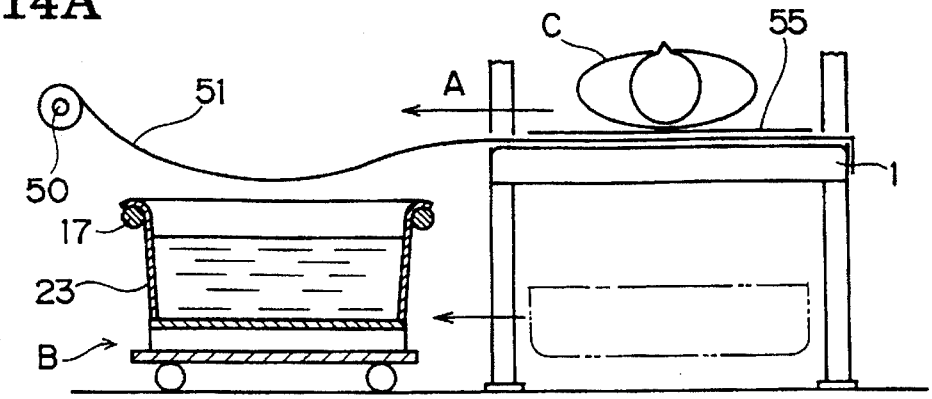
FIGS. 14A through 14D show a process of bathing a patient with the bathing aid system of FIG. 13.

The patient (C) is bathed with the bathing aid system thus constructed, for example, according to the following steps. As shown in FIG. 14A, the bathtub assembly (B) is moved from a first place under the bed (1) to a second place at the side of the bed (1) for use. The bathtub supporting frame (17) is held at the upper position and the bathtub (23) is filled with an appropriate volume of hot water, while the patient (C) lies on the second sheet member (55) mounted on the sheet member (51) spread over the bed (1). The sheet member (51) is spanned between the support shaft (50) and the bed (1) with some slack.

Figure 14B:
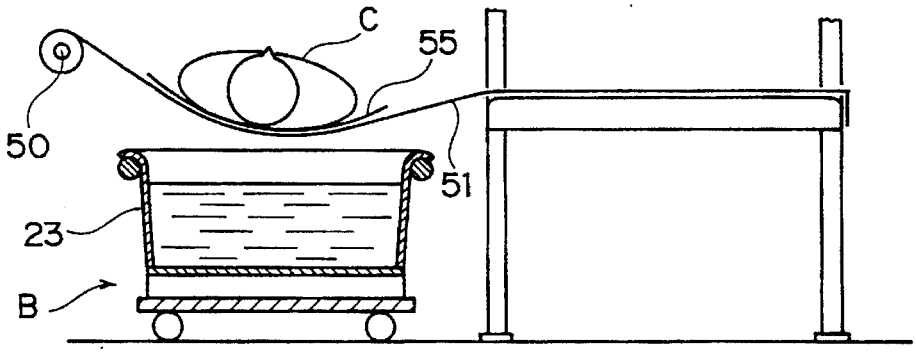

As shown in FIG. 14B, the second sheet member (55) with the patient (C) thereon is pulled in the direction (A) using the grip holes (56) of the second sheet member (55) (FIG. 13), so that the patient (C) is moved above the bathtub assembly (B). Since there is little friction between the sheet member (51) and the second sheet member (55), the second sheet member (55) with the patient (C) thereon can be easily slid along the sheet member (51) with a relatively small force. When the body of the patient (C) is taken off the bed (1), the sheet member (51) with some slack inclines towards the center of the bathtub (23), so that the patient (C) is easily moved to the center of the bathtub (23) as shown in FIG. 14B.

Figure 14C:
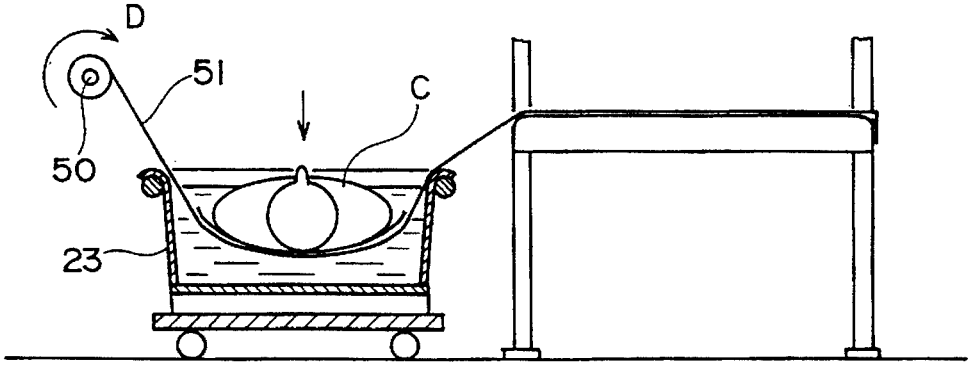

The support shaft (50) is then rotated clockwise, that is, in the direction (D) shown in FIG. 14C, through operations of the crank handle (53) (FIG. 13) of the driving gear. Clockwise rotation of the support shaft (50) winds the sheet member (51) off and lowers the patient (C) into the hot water in the bathtub (23).

Figure 14D:
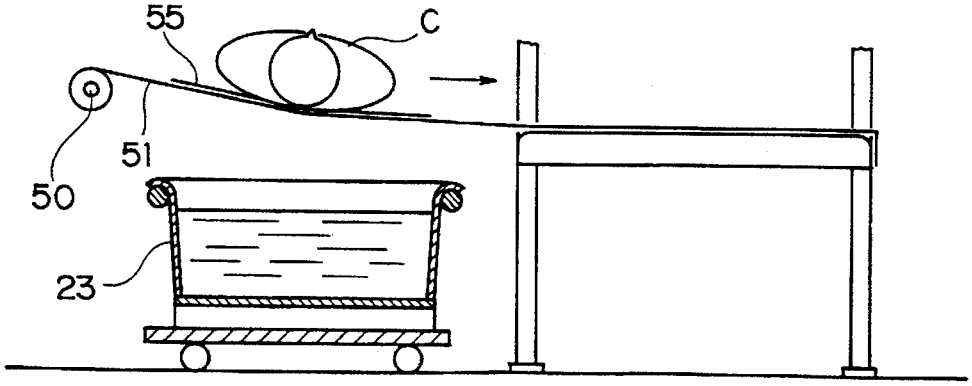

After bathing, the support shaft (50) is rotated counterclockwise using the crank handle (53) as shown in FIG. 14D. Counterclockwise rotation of the support shaft (50) winds the sheet member (51) on and elevates the patient (C) on the sheet member (51) from the bathtub (23). After the sheet member (51) is sufficiently wound on the support shaft (50), the body of the patient (C) is dried with towel or the like, and the second sheet member (55) with the patient (C) thereon is pulled onto the bed (1).

As described previously, the support shaft (50) is preferably held at a position a little higher than the upper surface of the bed (1). Under such condition, the sheet member (51) inclines from the support shaft (50) to the bed (1) as illustrated in FIG. 14D. This allows the patient (C) to be easily moved back to the bed (1).

The bathing aid system of the embodiment allows the lying patient (C) to be easily immersed in hot water in the bathtub (23) of the bathtub assembly (B) set on the side of the bed (1). The width of the sheet member (51) is uniformly wound off the support shaft (50), and the body of the patient (C) is uniformly lowered into the bathtub (23).

Figure 15:
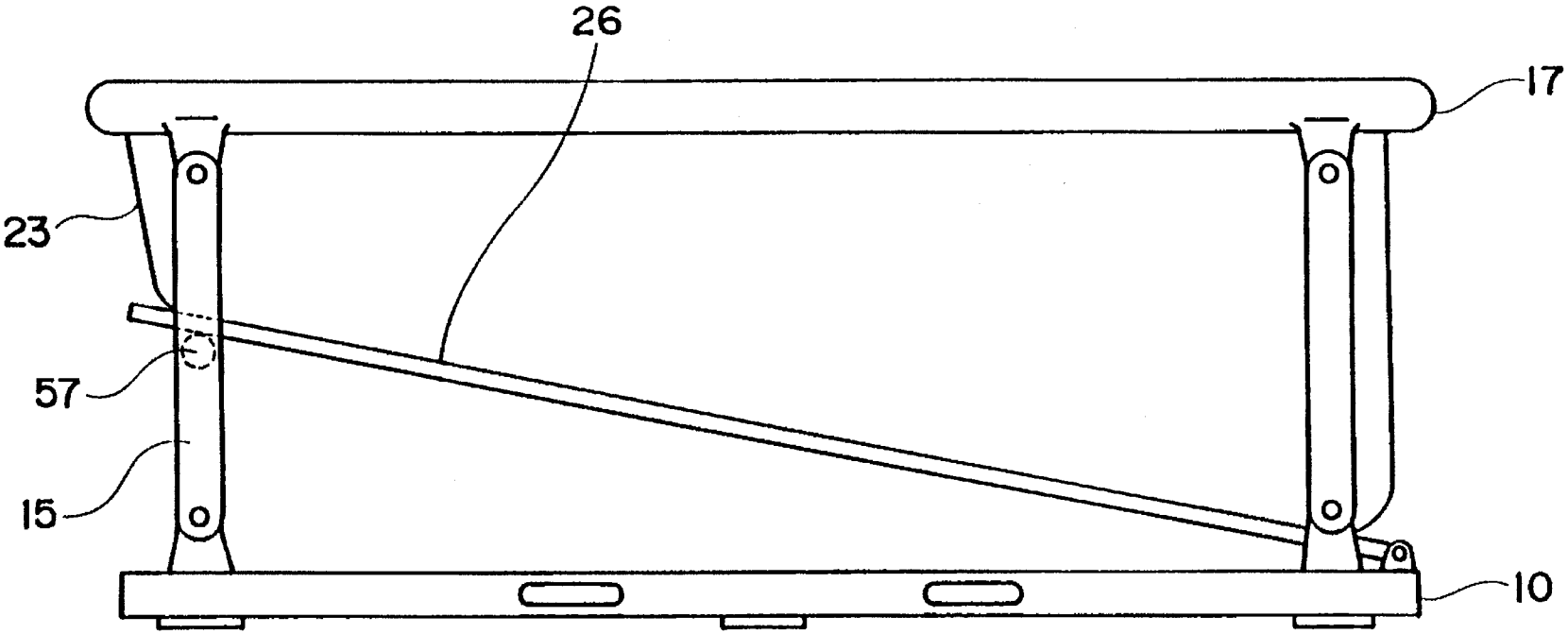
FIG. 15 is a front view illustrating a bathtub assembly having a greater inclination with a smaller depth at the head end.

It is thus apprehended that not only the lower half of the body of the patient (C) but the head may be immersed into hot water in the bathtub (23). This problem is solved by making the depth of the bathtub (23) on the head's side smaller or using the pillow (28) as illustrated in FIG. 4. FIG. 15 is a front view illustrating an example of such a bathtub assembly (B), where the depth of the bathtub (23) on the head's side is made smaller. One end of the bottom supporting plate (26) on the legs' side is fixed to the base 10 to allow pivotal movement of the bottom supporting plate (26), while the other end of the bottom supporting plate (26) on the head's side is slidably mounted on a horizontal member (57) attached to the link arm (15). This structure allows the bottom supporting plate (26) to be lifted on the head's side and inclined towards the legs' side, accompanied with the lifting movement of the bathtub supporting frame (17).

When the body of the patient (C) is lowered uniformly with the sheet member (51), the head of the patient (C) first comes into contact with and is supported by the shallower portion of the bottom of the bathtub (23). This effectively prevents the head of the patient (C) from being immersed into hot water in the bathtub (23). The lower part of the body of the patient (C) is immersed into hot water in the bathtub (23) by further winding the sheet member (51) off the support shaft (50).

The bathing aid system of the embodiment makes the sheet member spanned across the bathtub assembly and allows the lying patient on the sheet member to be immersed in hot water in the bathtub without difficulty or danger. This relieves the patient of uneasiness for bathing.

In the bathing aid system of the embodiment, the second sheet member having a small coefficient of friction against the sheet member is laid upon the sheet member, and the patient is shifted to the bathtub assembly while lying on the second sheet member. This structure helps a nurse of little strength bathe the patient without difficulty or danger.

The bathing aid system of the embodiment has relatively simple structure, thereby being manufactured at low cost and having little troubles.

Although the bathing aid system of the present invention is described according to the embodiment, the embodiment is only illustrative and not restrictive in any sense. There may be many modifications, alterations, and changes without departing from the scope or spirit of essential characteristics of the present invention. Some examples of modification are given below.

The support shaft (50) for winding the sheet member (51) thereon may be supported by one side of the bathtub supporting frame (17) of the bathtub assembly (B), in place of a separate base.

Figure 16:
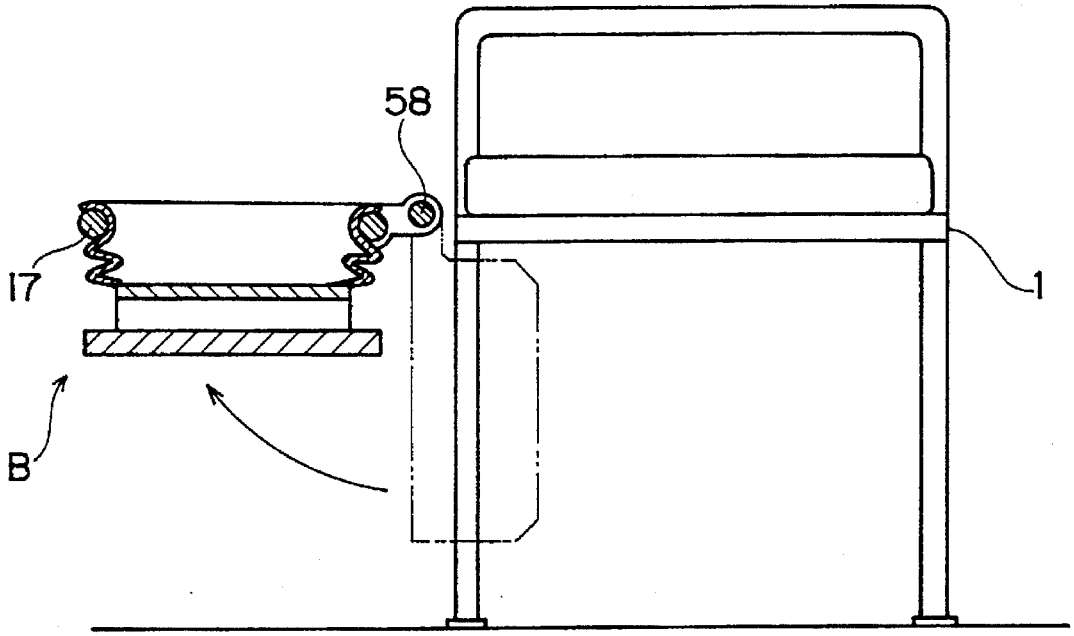
FIG. 16 shows a modification of transport mechanism for moving the bathtub assembly.

According to another application, one side of the bathtub supporting frame (17) of the bathtub assembly (B) is pivotally fixed to a shaft (58) attached to one side of the bed (1) as shown in FIG. 16. In this structure, the bathtub assembly (B) is rotated from a non-use position under the bed (1) shown by the phantom line to a use position on the side of the bed (1) shown by the solid line.

The bathing aid system of the embodiment may be applied for evacuation; a hole is formed in the sheet member at a position corresponding to the pelvic region of a patient, and the sheet member with the patient mounted thereon is inclined towards a toilet placed below the sheet member for evacuation.

When the bathtub assembly has a bottom plate vertically movable in the bathtub or when the base can be held at a position higher than the floor surface, a support plate pivotally fixed to one end of the bed, where the bathtub assembly is placed, may be used for the moving-aid mechanism, as described in the above embodiments.

As described above, the bathtub assembly of the present invention lifts up and lowers a bathtub supporting frame, which supports a foldable bathtub made of watertight cloth or plastic sheet. When in use, the bathtub assembly forms a bathtub having a sufficient depth for an appropriate volume of hot water. When not in use, on the other hand, the whole height of the bathtub assembly is sufficiently reduced to allow accommodation of the assembly in the space under the bed.

In one preferable structure, the bottom of the bathtub has a relatively large inclination. This allows water after bathing or shower to be rapidly discharged through the drain.

A power-driven system of high efficiency and easy operation or a simple and inexpensive manual system may be selected according to the requirements to be applied for vertical movement of the bathtub supporting frame.

The structures where the bathtub assembly has a bottom plate vertically movable in the bathtub or where the base can be held at a position higher than the floor surface allow a nurse having little strength to bathe a patient without difficulty or danger only by sliding the patient from the bed to the bathtub.

The scope and spirit of the present invention are limited only by the terms of the appended claims.

What is claimed is:

1. A bathtub assembly foldable to be accommodated in a space under a bed equipped with a lifting mechanism, said bathtub assembly comprising:

a base movable on a floor between a first place under the bed and a second place at a side of the bed;

a bathtub supporting frame mounted on said base to be movable between an upper position and a lower position; and a bathtub made of watertight flexible sheet and fixed at its upper periphery to said bathtub supporting frame, said bathtub supporting frame including a coupler element connectable to the bed such that the bathtub supporting frame can be raised to the upper position in connection with the bed by the lifting mechanism.

2. A bathtub assembly according to claim 1, said bathtub assembly further comprising a bottom supporting plate for supporting a bottom of said bathtub, said bottom supporting plate being inclined from a higher head end to a lower leg end.

3. A bathtub assembly according to claim 1, said bathtub assembly further comprising a plurality of link arms, which have joints in the middle thereof to allow folding movement of said link arms.

4. A bathtub assembly according to claim 3, said bathtub assembly further comprising a first support member located on each link arm and a second support member located on each portion of said base where the link arm is pivotally fixed, said first support member and said second support member holding each link arm in a substantially vertical, linear configuration when said bathtub supporting frame is in its upper position.

5. A bathtub assembly according to claim 1, said bathtub assembly further comprising a plurality of foldable legs attached to the base for raising the base to a substantially same level with the surface of the bed.

* * * * *